US008141600B2

(12) United States Patent
Khoo et al.

(10) Patent No.: US 8,141,600 B2
(45) Date of Patent: Mar. 27, 2012

(54) FLUID DISPENSER WITH IMPROVED SHELVING SYSTEM FOR ACCOMMODATING CONTAINERS OF VARIOUS SIZES

(75) Inventors: Christopher Khoo, Lake in the Hills, IL (US); William Miller, Buffalo Grove, IL (US)

(73) Assignee: Fluid Management Operations, LLC, Wheeling, IL (US)

( * ) Notice: Subject to any disclaimer, the term of this patent is extended or adjusted under 35 U.S.C. 154(b) by 1380 days.

(21) Appl. No.: 11/735,776

(22) Filed: Apr. 16, 2007

(65) Prior Publication Data

US 2008/0251546 A1 Oct. 16, 2008

(51) Int. Cl.
*B65B 1/04* (2006.01)

(52) U.S. Cl. ..... 141/105; 141/86; 141/102

(58) Field of Classification Search ..... 141/9, 86, 141/100–105; 222/108, 132
See application file for complete search history.

(56) References Cited

U.S. PATENT DOCUMENTS 5,361,812 A * 11/1994 Arneson et al. ..... 141/275
5,493,840 A * 2/1996 Cane ..... 53/50
5,697,527 A * 12/1997 Altieri et al. ..... 222/132
D472,253 S * 3/2003 Reedy et al. ..... D15/147
6,926,171 B2 * 8/2005 Reedy et al. ..... 222/108
7,562,680 B2 * 7/2009 Khoo et al. ..... 141/86

* cited by examiner

*Primary Examiner* — Timothy L Maust
(74) *Attorney, Agent, or Firm* — Miller, Matthias & Hull LLP

(57) ABSTRACT

A paint dispenser for dispensing paint components such as colorants and possibly base into 5 gallon and 1 gallon containers is disclosed. The paint dispenser includes a cabinet for accommodating a plurality of colorant and optionally base canisters in communication with a common dispense outlet. The canisters may be connected to individual pumps which, in turn, are connected to a dispense outlet. A container shelf unit is disposed in front of the cabinet and below the dispense outlet. The shelf unit includes a base including a plurality of rollers particularly suitable for supporting and moving 5 gallon pails of paint. The base is disposed below the dispense outlet a first vertical distance sufficient to permit the 5 gallon cylindrical containers to be disposed on top of the rollers and below the dispense outlet without engaging the dispense outlet. The shelf unit further a pivoting shelf being pivotally connected to the cabinet above the base. The pivoting shelf pivots between a first vertical position where the shelf is flat against the vertical cabinet thereby enabling a 1 gallon pail to be disposed on top of the rollers and below the dispense outlet.

19 Claims, 8 Drawing Sheets

FLUID DISPENSER WITH IMPROVED SHELVING SYSTEM FOR ACCOMMODATING CONTAINERS OF VARIOUS SIZES

FIELD OF THE DISCLOSURE

A system for dispensing multiple fluids into a receptacle is disclosed. More specifically, a multiple fluid dispense system is disclosed which is modular in design, can accommodate container receptacles of at least two different sizes and which includes a drip containment system.

BACKGROUND OF THE DISCLOSURE

Automated fluid dispensers for dispensing multiple types of fluids such as paint colorants are known. Further, such multiple fluid dispensers ale often computerized or linked to a controller which controls the dispensing of the various fluids. For example, modern paint colorant dispensers often include a cabinet or housing that accommodates a plurality of colorant canisters with each canister connected to its own pump. The pumps are all linked to a controller which controls the sequence and amount of the various colorants dispensed based upon data entered through a keyboard or terminal. Such dispensers typically include a single dispense outlet and a shelf disposed under the outlet for supporting the paint can or container. While the currently available automated fluid dispensers are effective in accurately this dispensing a plurality of different colorants, the designs of these dispensers suffer from common drawbacks.

For example, the dispensers are quite large due to the necessity of the cabinet housing a plurality of colorant canisters, such as eight or more and a separate pump for each canister. The bulkiness of the dispenser is exacerbated by the need to include a controller, such as a central processing unit, a keyboard and a monitor and cabinet space to house these items. Further, some dispensers must include a large number of different colorants thereby increasing the size of the cabinet that holds the canisters.

These automated paint colorant dispensers are typically utilized in the paint department of a hardware store or other retail facility. Because each store or retail facility is designed differently, many retailers are faced with the difficult task for making room for such large automated paint colorant dispensers in areas of limited space. As a result, there is a need for a more flexible design for automated paint colorant dispensers which would enable the configuration of these dispensers to be easily altered, depending upon the facility in which they are to be installed.

Further, most automated paint colorant dispensers are designed to dispense paint colorants into a large, five gallon pail or container. As a result, the shelf that supports the container is disposed vertically below the dispense outlet a sufficient distance so as to permit a five gallon container to be disposed on top of the supporting shelf but below the dispense outlet or nozzle. However, paint retailers also mix and sell paints in smaller quantities such as single gallons, quarts and pints. When a retailer needs to custom mix a smaller quantity of paint using an automated dispenser designed to dispense colorants into larger five gallon containers, a smaller container is disposed so far below the dispense outlet that splashing of the colorant as it reaches the smaller container is common and problematic. Obviously, when the colorant splashes outside of the container, the accuracy of the resulting paint color is compromised. Further, splashing of paint colorant outside of the container receptacle also results in colorant being splattered onto the dispensing apparatus causing it to be unsightly and in need of frequent clean-up. Thus, there is a need for an improved paint colorant dispenser design which enables the dispenser to easily accommodate large and small containers to thereby eliminate the splashing problem.

Finally, after the appropriate colorants are dispensed into the container, the container is then moved away from the dispense outlet, sealed and then shaken in a mechanical mixing device. However, fluid colorant often will continue to drip from the dispense outlet down onto the supporting shelf or conveyor. As a result, the colorant soils the shelf or conveyor, presents an unsightly appearance and requires additional clean-up. Thus, there is a need for an improved paint colorant dispenser design which addressed this dripping problem.

More broadly, multiple fluid dispensing technology originally developed for the paint industry has expanded to foods, cosmetics, pharmaceutical, etc. Thus, the problems associated with the dispensing multiple fluids into containers of varying sizes extends beyond the paint industry to the food, beverage, pharmaceutical, cosmetics and other unrelated industries. Therefore, there is a need for an improved multiple fluids dispenser design which addressed the dripping problems and the problems associated with accommodating containers of varying sizes as discussed above.

SUMMARY OF THE DISCLOSURE

In satisfaction of aforenoted needs, an improved fluid dispenser for dispensing multiple fluids into large containers and small containers is disclosed. The disclosed dispenser comprises a cabinet for accommodating a plurality of canisters in fluid communication with a common dispense outlet A container shelf unit is disposed in front of the cabinet and below the dispense outlet.

The shelf unit comprises a horizontal base disposed in front of the cabinet and vertically below the dispense outlet by a first vertical distance sufficient to permit a large container to be disposed on top of the base and below the dispense outlet. Thus, the horizontal base is used to support large containers during the dispense. In one disclosed embodiment, the horizontal base includes a framed structure with a plurality of parallel and horizontal rollers that provide a horizontal bed for supporting and moving large containers.

The shelf unit further comprises a pivoting shelf pivotally connected to the cabinet above the horizontal base. The pivoting shelf pivots between a first vertical position and a second horizontal position. In the first vertical position, the pivoting shelf abuttingly engages the cabinet or lies flat against the cabinet and provides clearance between the dispense outlet and horizontal base thereby enabling a large container disposed on the horizontal base to be filled. In the second horizontal position, the pivoting shelf is disposed above the horizontal base and below the dispense outlet with the pivoting shelf disposed below the dispense outlet to permit a small container to be disposed on top of the pivoting shelf and below the dispense outlet.

Thus, the term "shelf unit" hereinafter refers to the combination of the horizontal base and the pivoting shelf for accommodating large and small containers respectively.

In a refinement, the pivoting shelf comprises a nesting mechanism for a releasably positioning the pivoting shelf in the second horizontal position and for releasably positioning the pivoting shelf in the first vertical position. The term "nesting mechanism" relates to the various hardware components used to move the pivoting shelf from the first vertical or home position to the second horizontal position with a shelf can accommodate and support a smaller container under the manifold.

In a further refinement of this concept, nesting mechanism comprises a stationary frame coupled to the cabinet, an upper arm pivotally connecting the pivoting shelf to the frame, and a lower arm pivotally connecting the pivoting shelf to the frame. The upper arm is pivotally connected to the frame above the lower arm and the upper arm is also pivotally connected to the pivoting shelf at a first point along the pivoting shelf The first point along the pivoting shelf is disposed above a second point where the lower arm is pivotally connected to the pivoting shelf when the pivoting shelf is in the first vertical or home position. Therefore, the upper arm is connected to the frame or cabinet above the lower arm and, when the pivoting shelf is in the horizontal position, the upper arm is connected to the pivoting shelf at a pivot point that is farther away from the cabinet then the point where the lower arm is connected to the pivoting shelf For the sake of simplicity, the description of the upper and lower arms will refer to a singular upper arm in a singular lower arm. However, those skilled in the art will appreciate that a sturdy design will include a matching pair of upper and lower arms at either end of the pivoting shelf with one upper and lower arm on one end of the pivoting shelf and another upper and lower arm disposed at an opposite end of the pivoting shelf.

In another refinement, the pivoting shelf further comprises a lower foot disposed below the lower arm. The lower foot engages the lower arm when the pivoting shelf is in the second horizontal position to hold the pivoting shelf in the second horizontal position and prevent further downward pivotal movement of the shelf beyond the second horizontal position.

In a further refinement of this concept, the lower foot comprises an adjustment mechanism for leveling the pivoting shelf when the pivoting shelf is in the second horizontal position. In still a further refinement of this concept, the adjustment mechanism comprises a threaded shaft threadably connected to the lower foot.

In still a further refinement of this concept, lower feet are disposed on either end of the pivoting shelf and each lower foot may include its own adjustment mechanism.

In another refinement, either the upper or lower arm or the pivoting shelf may be connected to a spring that, in turn, is connected to the cabinet or the frame for biasing the pivoting shelf towards the first vertical position In another refinement, the pivoting shelf comprises a drip opening in alignment with a drip opening disposed in the horizontal base and in alignment with the dispense outlet.

In a further refinement of this concept, the horizontal base comprises a drip container disposed below the drip opening of the horizontal base.

In another refinement, the horizontal base further comprises a set of rollers disposed on the base.

In still another refinement, the horizontal base further comprises a set of rollers disposed on the base on either side of the drip hole disposed in the base.

The drip containment system disposed in the horizontal base may include an upper drip plate removably disposed on top of a drip container disposed in the horizontal base.

An improved paint dispenser for dispensing paint components such as colorants and base into 5 gallon and 1 gallon containers is also disclosed. The improved paint dispenser comprises a cabinet for accommodating a plurality of colorant and base canisters in communication with a common dispense outlet. The canisters may be connected to individual pumps which, in turn, are connected to the dispense outlet. The dispense outlet may be a manifold or manifold-block type.

A container shelf unit is disposed in front of the cabinet and below the dispense outlet. The shelf unit comprises a base comprising a plurality of rollers particularly suitable for supporting and moving 5 gallon pails of paint. The base is disposed below the dispense outlet a first vertical distance sufficient to permit the 5 gallon cylindrical containers to be disposed on top of the rollers and below the dispense outlet without engaging the dispense outlet.

The shelf unit further comprising a pivoting shelf being pivotally connected to the cabinet above the base. The pivoting shelf pivots between a first vertical position where the shelf is flat against the vertical cabinet thereby enabling a 5 gallon pail to be disposed on top of the rollers and below the dispense outlet. The shelf also pivots downward to a second horizontal position where the shelf is disposed above and parallel to the rollers and below the dispense outlet. In the second horizontal position, the pivoting shelf can support a 1 gallon can below the dispense outlet without engaging the dispense outlet.

Preferably, the pivoting shelf has an opening in alignment with the dispense outlet for the passage of drips there through to a drip opening disposed in the horizontal base. Preferably, a removable container is disposed in the base and below the opening of the base so that collected drips of colorant and base material may be collected.

Other advantages and features will be apparent from the following detailed description when read in conjunction with the attached drawings.

BRIEF DESCRIPTION OF THE DRAWINGS

The disclosed dispensers are described more or less diagrammatically in the accompanying drawings wherein.

While limited embodiments are shown and described, alternative embodiments and variations will be described below and still other variations will be apparent to those skilled in the art. It should also be understood that the drawings are not necessarily to scale and that the disclosed embodiment is sometimes illustrated diagrammatically and in partial views. In certain instances, details which are not necessary for an understanding of the disclosed methods and apparatus or which render other details difficult to perceive may have been omitted. It should be understood, of course, that this disclosure is not limited to the particular embodiment illustrated herein.

DETAILED DESCRIPTION OF THE DISCLOSURE

Figure 1:
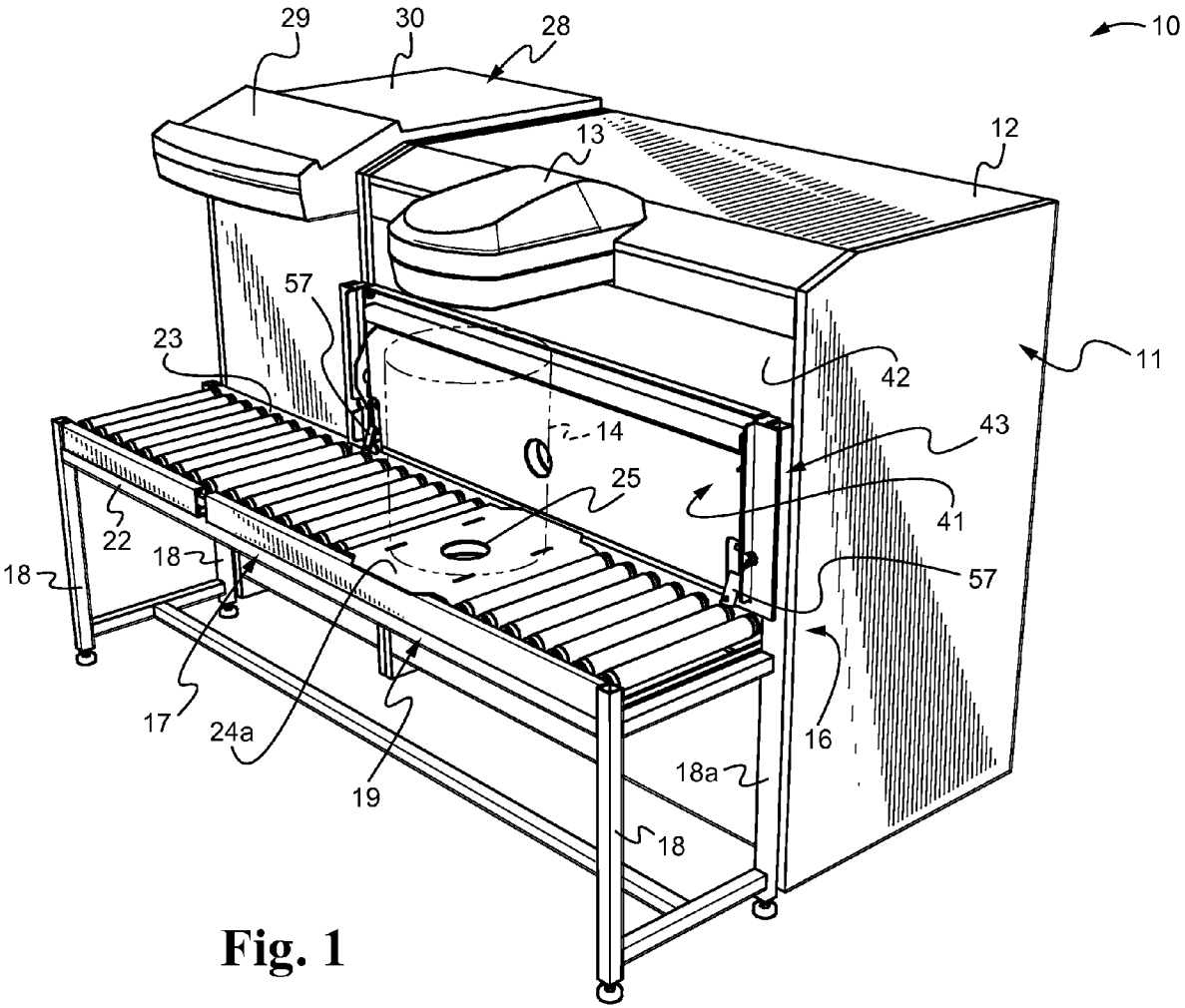
FIG. 1 is a perspective view of one disclosed fluid dispensing apparatus with the pivoting shelf in the vertical or home position for dispensing into a larger container.
Figure 2:
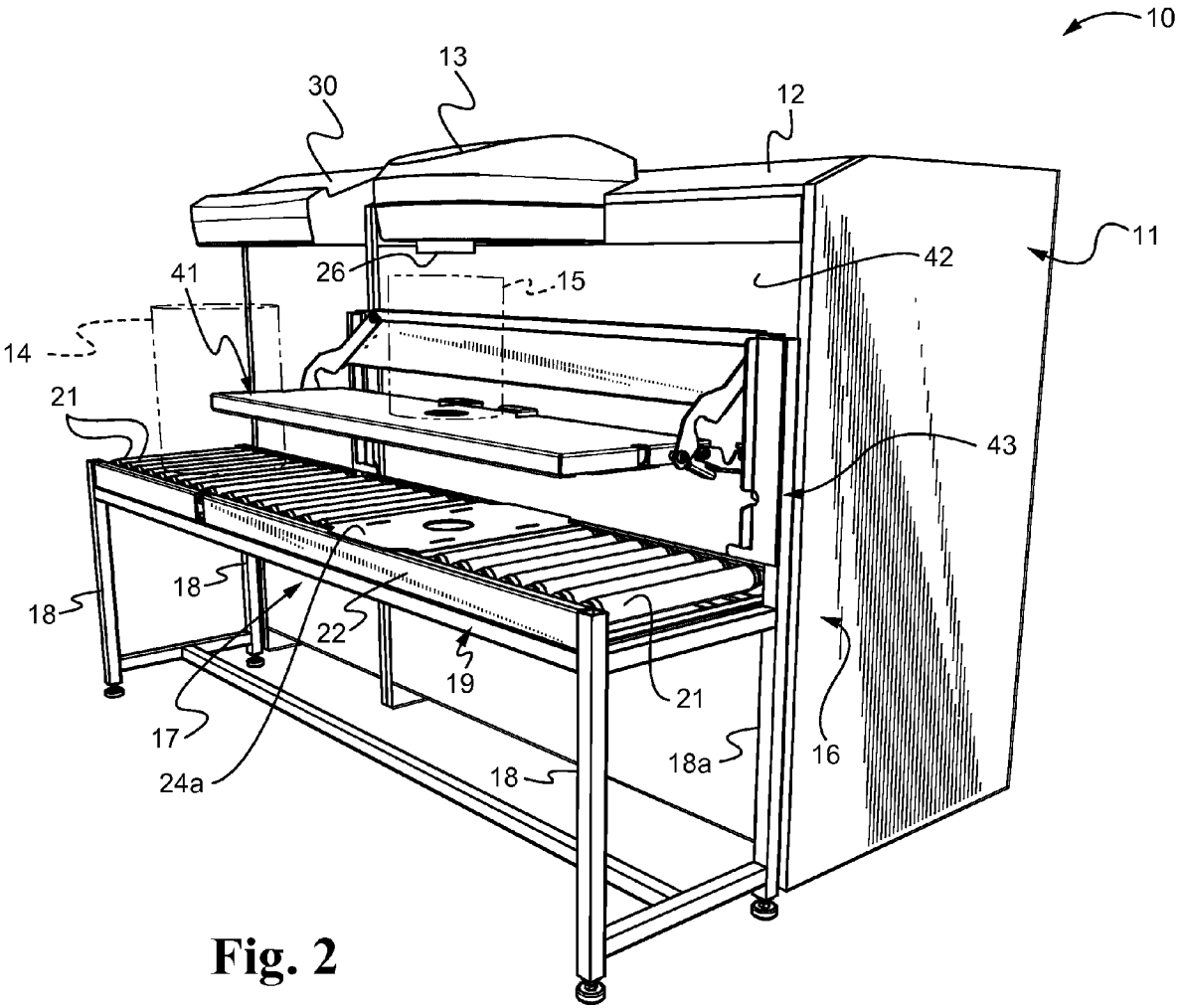
FIG. 2 is another perspective view of the disclosed fluid dispensing apparatus FIG. 1 with the pivoting shelf in the horizontal position for accommodating a smaller container.
Figure 3:
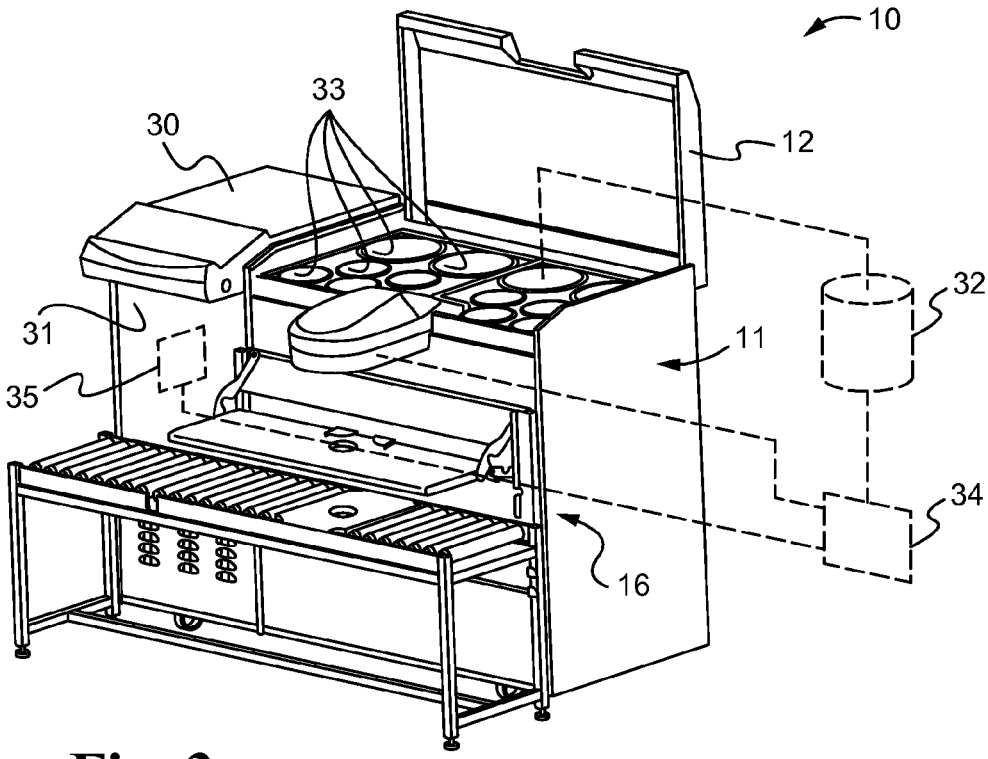
FIG. 3 is a perspective view of a disclosed fluid dispensing apparatus with the pivoting shelf in the vertical or home position and with the cabinet lid raised to expose the canisters.
Figure 4:
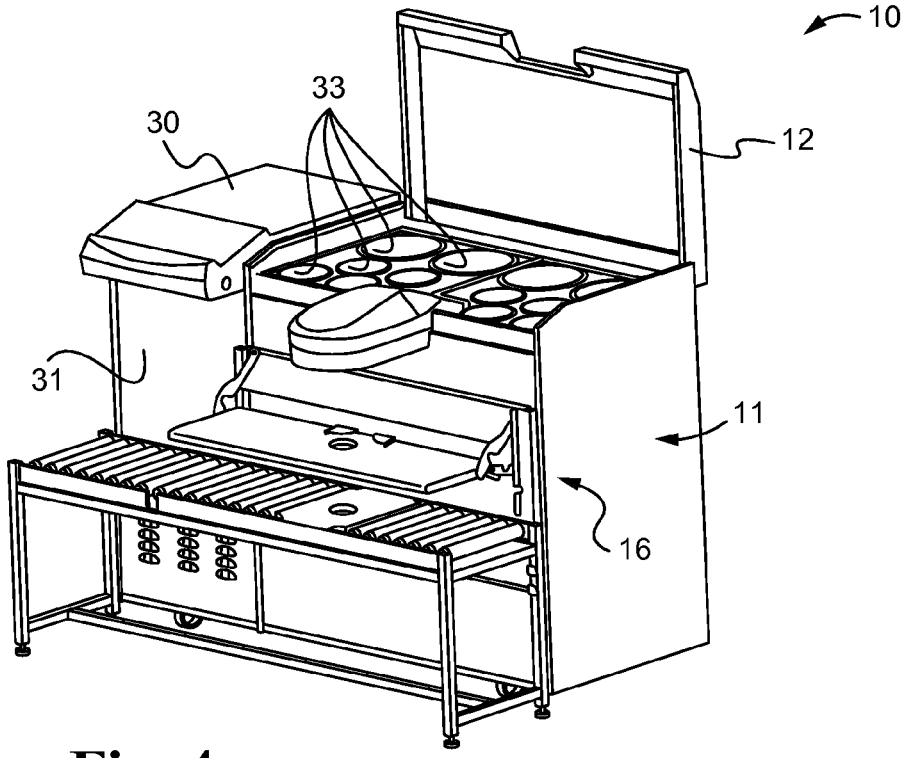
FIG. 4 is another perspective view of a disclosed fluid dispensing apparatus of FIG. 3 with the pivoting shelf in the horizontal position for dispensing into smaller containers and with the cabinet lid raised to expose the canisters.

Turning first to FIGS. 1-4, a dispenser 10 is illustrated in which includes a canister cabinet 11 equipped with a pivoting lid 12 (see FIGS. 3-4). The canister cabinet 11 accommodates a plurality of canisters that hold different fluids for dispensing through the dispense outlet or manifold 13 to either a large a container 14 as shown in FIG. 1 or a smaller container 15 as shown in FIG. 2. The ability to easily dispense in either a large container 14 or a small container 15 is derived from the shelf unit shown generally at 16.

The shelf unit 16 comprises a base 17 which, in the embodiment shown, comprises a frame with vertical legs 18 at support a horizontal bed 19 that turn, includes a plurality of rollers 21 to facilitate moving large containers 14 which, maybe 5 gallon containers or larger depending upon the area of use and common sizes. For example, in the United States, 5 gallon paint containers 14 are common and therefore the dimensions shown in the drawings are suitable for 5 gallon containers 14 and 1 gallon containers 15 as shown. Obviously, the dimensions may be altered for different parts of the world with different common container sizes. For example, liquid are also sold in metric containers, such as 1 liter, 5 liter, 10 liter, 50 liter, etc.

The bed 19 may comprise a pair of front and rear frame members 22, 23 that support the rollers 21. In a preferred embodiment as shown in FIGS. 1-4, the base 17 also includes a drip plate 24*a* with a drip hole or opening 25 disposed therein for catching drips causing downward or from the manifold block 26 (FIG. 2) disposed beneath the manifold or outlet housing 13. The drip pan 24 includes a bottom portion disposed beneath the opening 25 for containing any material dripping from the manifold block 26 or the manifold 13.

Still referring to FIGS. 1-4, the dispenser 10 also includes an additional modular cabinet 28 ideally suited for accommodating a computer or CPU (not shown). A keyboard rest 29 is disposed in front of a surface 30 which can be used to support a monitor as well is a CPU (not shown). The cabinet 28 may be moved to either side of the cabinet 11, depending upon the needs of the user FIGS. 3 and 4 illustrate a space 31 for accommodating electronic components. Generally speaking, dispensers of the type shown at 10 in the figures are modular in design. That each canister 32 accommodated in one of the canister openings 33 is also connected to its own pump 34 which, in turn, is linked to the CPU 34 as illustrated schematically in FIG. 3.

FIGS. 1 and 3 illustrates the shelf unit 16 in the vertical or "home" position while FIGS. 2 and 4 illustrate the shelf unit 16 in the horizontal position. In the first vertical position illustrated in FIGS. 1 and 3, the dispenser 10 can easily accommodate a large container 14, such as a 5 gallon pail. In the second horizontal position shown in FIGS. 2 and 4, the dispenser assembly 10 can easily accommodate a smaller container 15 such as a 1 gallon pail.

The shelf unit 16 includes a pivoting shelf 41 that is pivotally connected to the front 42 of the cabinet 11 by a nesting mechanism 43, the details of which will be described in greater detail in connection with FIGS. 5-6 and with the operation of the nesting mechanism 43 in describing greater detail in connection with FIGS. 7-8.

Figure 5:
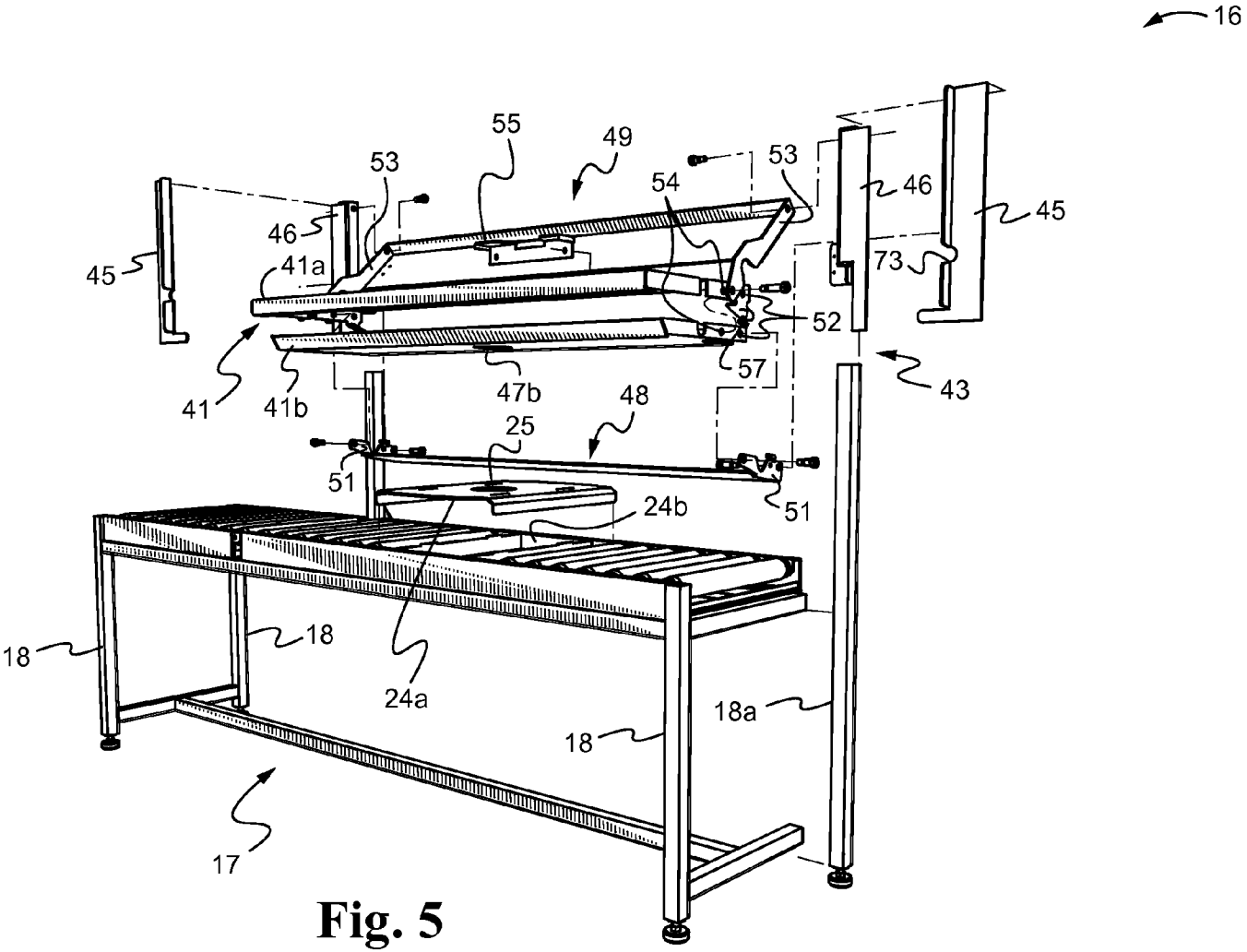
FIG. 5 an exploded view of the shelf unit of the dispensing apparatus of FIGS. 1-4 with the pivoting shelf in the horizontal position.
Figure 6:
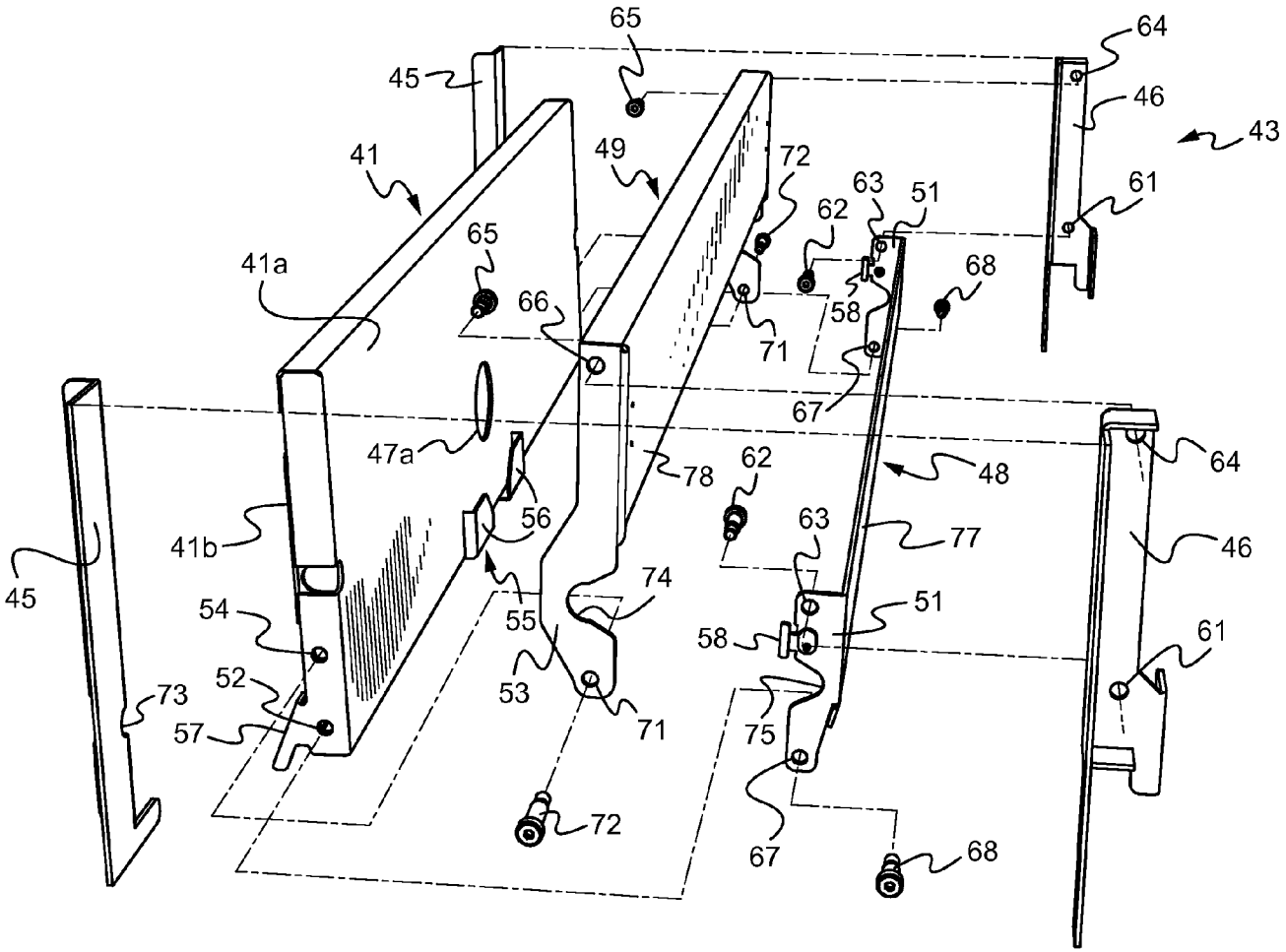
FIG. 6 an exploded view of the shelf unit of the dispensing apparatus of FIGS. 1-5 with the pivoting shelf in the vertical or home position.

FIG. 5 is an exploded view of the entire shelf unit 16 with the pivoting shelf 41 and a nesting unit 43 in the horizontal position while FIG. 6 is an exploded view of the shell 41 and nesting unit 43 in the vertical or home position. Turning first to this FIG. 5, the base 17 is disposed in front of the cabinet 11 (FIGS. 1-4). The base 17 includes a vertical support legs 18. One rear leg 18*a* can extend upward above the base and be used to secure the inner and outer frame members 45, 46 respectively in place on the front 42 of the cabinet 11. As shown in FIG. 5, the pivoting shelf 41 includes an upper half 41*a* and a lower half 41*b*. As shown in FIG. 6, the upper and lower components 41*a*, 41*b* are connected together and each will include a drip opening 47*a*, 47*b* for the passage of fluid from the manifold 13 through the openings 47*a*, 47*b* and through the opening 25 in the drip plate 24*a* which is disposed above the drip pan 24*b*. The two-piece construction 41*a*, 41*b* is not necessary but is just one design for the pivoting shelf 41. More or fewer than two members 41*a*, 41*b* may be employed. The shell 41 is pivotally connected to the front 42 of the cabinet 11 using two U-shaped members shown generally at 48, 49.

Turning to FIG. 6, the member 48 provides a pair of lower arms 51 connected on either side of the shelf 41 at the pivot hole 52 disposed closest to the cabinet 11. The member 49 provides upper arms 53 that are connected to the shell 41 at the pivot holes 54 disposed farther away from the cabinet 11 than the pivot holes 52. Thus, the upper arms 53 are connected to the shell 41 above the lower arms 51 and farther away from the cabinet 11 than the lower arms 51. The shelf member 41*a* is connected to a guide member 55 that includes a pair of opposing arms 56 that form an opening for receiving a lower outer periphery of a smaller container 14 when the shelf 41 is disposed in the horizontal position shown in FIGS. 2, 4 and 5. The shelf member 41*a* is also connected to a lower foot 57 that serves as a stop when the shelf 41 is moved to the horizontal position as will be explained in greater detail in connection with FIG. 8. The extensions 58 disposed on the upper arms 51 can be used to receive one end of a spring (not shown), the other end of the spring connected to a fixed structure such as the cabinet 11 or one of the frame members 45, 46.

Still referring to FIG. 6, the inner frame member 46 includes a lower opening 61 that receives the pin 62 that connects the lower arm 51 to the inner frame 46 at the proximal opening 63. The inner frame 46 also includes an upper opening 64 and receives the pin 65 for connecting the upper arm 53 to the inner frame 46 at the proximal opening 66 of the upper arm 53. Thus, the inner frame 46 is connected to the proximal ends or proximal openings 66, 63 of the upper and lower arms 53, 51 respectively.

Figure 9:
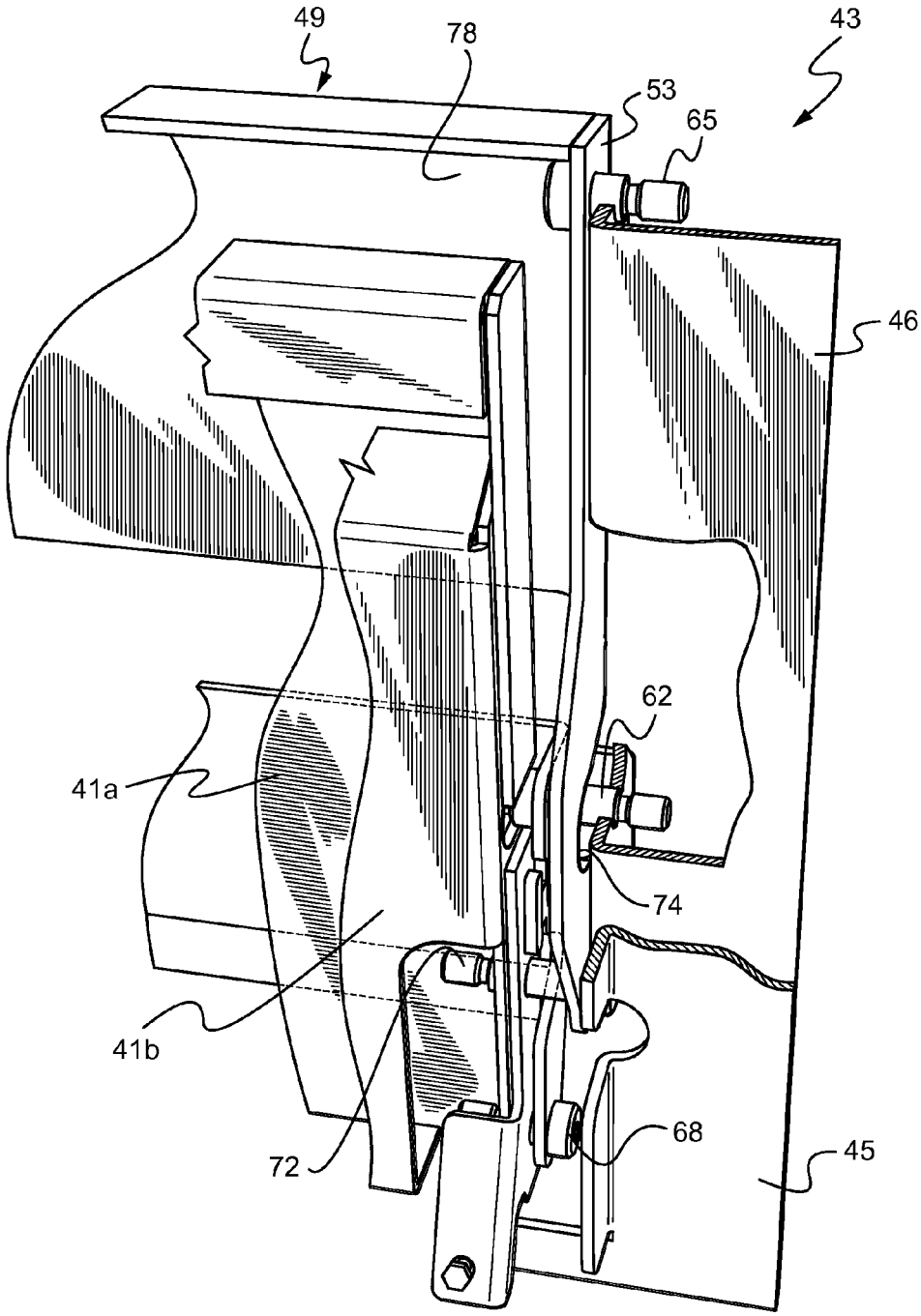
FIG. 9 is another partial perspective view of the shelf unit shown in FIGS. 5-8 with the pivoting shelf in the vertical or home position shown in FIGS. 1 and 3.

The distal opening 67 of the lower arm 53 is connected to the proximal opening or pivot 52 in the shelf 41 by the pin 68. Similarly, the distal opening 71 in the upper arm 53 is connected to the distal opening or pivot 54 in the shell 41 by the pin 72. The outer frame members 45 largely serve as protective covers for the inner frame members 46 and the pivotal connections associated therewith. However, the outer frame members 45 include a recess 73 for accommodating the pin 72 as it moves to the vertical or home position as seen in FIGS. 7 and 9. Similarly, the upper arm 53 includes a recess 74 for accommodating the pin 62 and the lower arm 51 includes a recess 75 for accommodating the pin 72 when the nesting unit 43 is placed in the home are vertical position as shown in FIGS. 1, 3 and 9 The recess 79 in the shelf 41 also is intended to accommodate for the presence of the pin 62 when the nesting unit 43 is in the vertical or collapsed position.

Figure 7:
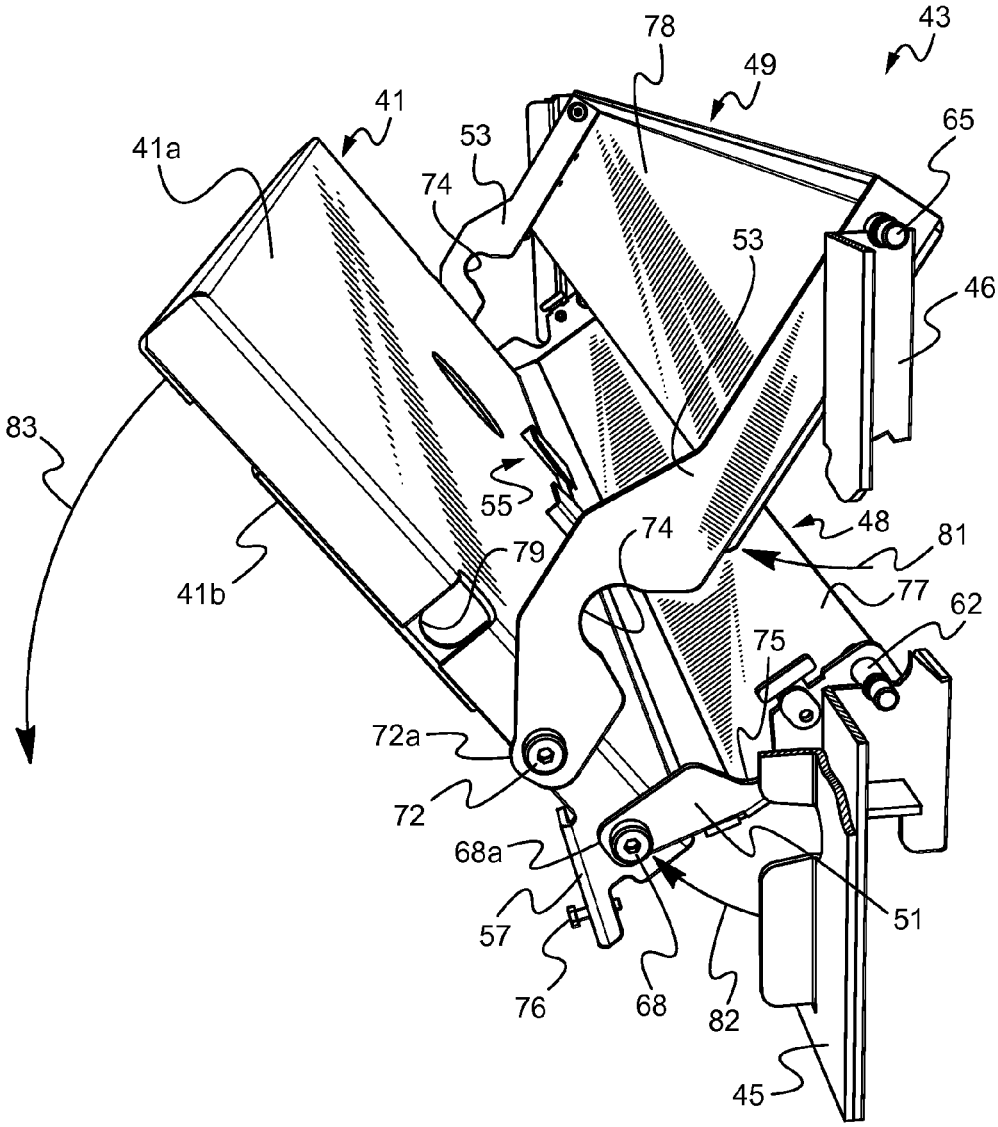
FIG. 7 is a partial perspective view of the shelf unit shown in FIGS. 5-6 with the pivoting shelf between the vertical or home position of FIGS. 1 and 3 and the horizontal position of FIGS. 2 and 4.

Turning to FIG. 7, the lower foot 57 is equipped with a threaded shaft 76. When the shelf 41 is in the horizontal position, the foot 57 or, more specifically, the threaded shaft 76, engages the underside of the lower arm member 48 or, more specifically, the underside of the cross plate 77 that connects the lower arms 51 together Utilizing the threaded shaft 76, a user can "level" the shell 41 when the shell 41 is in the horizontal position. Lower feet 57 are disposed on both lower arms 51 and, preferably, threaded shafts 76 are also provided on each lower foot 57. As seen in FIG. 8, the threaded fastener 76 is easily accessible when the nesting unit 43 is in the horizontal position Similar to the lower arm member 48, the upper arm member 49 also includes a cross plate 78 that connects the upper arms 53 together. The dual arm and cross plate combinations 51, 77, 51 and 53, 78, 53 of the lower and upper members 48, 49 provides strength and stability to the nesting mechanism 43.

Figure 8:
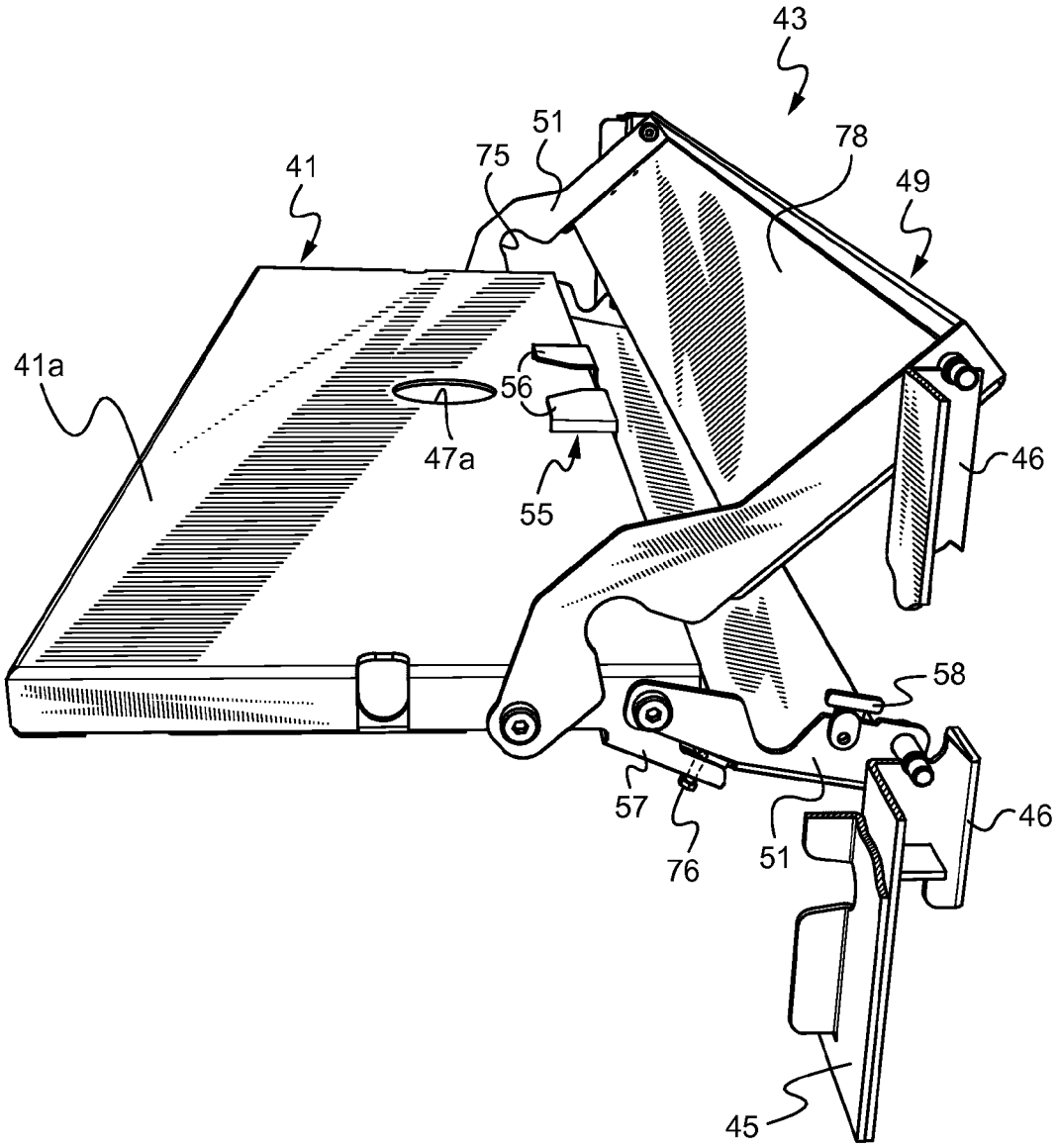
FIG. 8 is another partial perspective view of the shelf unit shown in FIGS. 5-7 with the pivoting shelf in the horizontal position of FIGS. 2 and 4.

As the nesting unit 43 is moved from the vertical position shown in FIGS. 1, 3 and 9 through the position shown in FIG. 7 to the position shown in FIGS. 8, 2 and 4, the distal end 72*a* of each upper arm 53 moves upwardly and outwardly as indicated by the by the arrow 81 shown in FIG. 7 and the distal end 68*a* lower arm 51 also moves upwardly and outwardly as indicated by the arrow 82 while the shelf assembly 41 moves outward and downward as indicated by the arrow 83.

As seen in FIG. 8, extension 58 can be used to attach the lower arm 51 to a spring which can connect the lower arm 51 to one of the frame members 45, 46 or cabinet 11 for purposes of biasing the nesting unit 43 towards the vertical or home position shown in FIGS. 1, 3 and 9. Movement of the nesting unit 43 from the vertical to the horizontal positions can be seen sequentially from FIGS. 9, 7 and then 8 while the reverse sequence can be seen from FIGS. 8, 7 and then 9.

The foregoing description of the exemplary embodiment has been presented for purposes of illustration and description. This disclosure is not intended to be limited to particular embodiment illustrated herein and the alternative embodiments described herein. Other alternatives, modifications and variations will be apparent to those skilled in the art in light of the above disclosure. The disclosed closure system is applicable to almost any fluid dispensing apparatus that dispenses single or multiple fluids. Accordingly, this disclosure is intended to embrace all alternatives, modifications and variations that fall within the spirit and scope of the appended claims.

What is claimed is:

1. A fluid dispenser for dispensing multiple fluids into large containers and small containers, the dispenser comprising:

a cabinet for accommodating a plurality of canisters in fluid communication with a common dispense outlet, a container shelf unit disposed in front of the cabinet and below the dispense outlet, the shelf unit comprising a horizontal base disposed in front of the cabinet and below the dispense outlet a first vertical distance sufficient to permit a large container to be disposed on top of the base and below the dispense outlet, the shelf unit further comprising a pivoting shelf pivotally connected to the cabinet above the horizontal base and below the dispense outlet, the pivoting shelf being pivotable between a first vertical position where the pivoting shelf abuttingly engages the cabinet and providing clearance between the dispense outlet and horizontal base and a second horizontal position where the pivoting shelf is disposed above the horizontal base and below the dispense outlet, in the second horizontal position, the pivoting shelf being disposed below the dispense outlet a second vertical distance sufficient to permit a small container to be disposed on top of the pivoting shelf and below the dispense outlet, a nesting mechanism for a releasably positioning the pivoting shelf in the second horizontal position and for releasably positioning the pivoting shelf in the first vertical position, the nesting mechanism comprising a stationary frame coupled to the cabinet, an upper arm pivotally connecting the pivoting shelf to the frame, and a lower arm pivotally connecting the pivoting shelf to the frame, the upper arm being pivotally connected to the frame above the lower arm and the upper arm being pivotally connected to the pivoting shelf at a first point along the pivoting shelf disposed above a second point where the lower arm is pivotally connected to the pivoting shelf when the pivoting shelf is in the first vertical position.

2. The fluid dispenser of claim 1 wherein the pivoting shelf further comprises a lower foot disposed below the lower arm, the lower foot engaging the lower arm when the pivoting shelf is in the second horizontal position to hold the pivoting shelf in the second horizontal position and prevent further downward pivotal movement of the shelf beyond the second horizontal position.

3. The fluid dispenser of claim 2 wherein the lower foot comprises an adjustment mechanism for leveling the pivoting shelf when the pivoting shelf is in the second horizontal position.

4. The fluid dispenser of claim 3 wherein the adjustment mechanism comprises a threaded shaft threadably connected to the lower foot.

5. The fluid dispenser of claim 1 wherein the lower arm is connected to a spring that, in turn, is connected to the cabinet for biasing the pivoting shelf in the first vertical position.

6. The fluid dispenser of claim 1 wherein the pivoting shelf comprises a drip opening in alignment with a drip opening disposed in the horizontal base and in alignment with the dispense outlet.

7. The fluid dispenser of claim 6 wherein the horizontal base comprises a drip container disposed below the drip opening of the horizontal base.

8. The fluid dispenser of claim 1 wherein the horizontal base further comprises a set of rollers disposed on the base.

9. The fluid dispenser of claim 7 the horizontal base further comprises a set of rollers disposed on the base on either side of the drip hole disposed on the base.

10. A paint dispenser for dispensing paint components into 5 gallon and 1 gallon containers, the dispenser comprising:

a cabinet for accommodating a plurality of colorant and base canisters in communication with a common dispense outlet, a container shelf unit disposed in front of the cabinet and below the dispense outlet, the shelf unit comprising a base comprising a plurality of rollers, the base disposed below the dispense outlet a first vertical distance sufficient to permit a 5 gallon cylindrical container to be disposed on top of the rollers and below the dispense outlet, the shelf unit further comprising a pivoting shelf being pivotally connected to the cabinet above the base, the pivoting shelf being pivotable between a first vertical position where the pivoting shelf is disposed above the rollers and against the cabinet providing clearance between the dispense outlet in the base, and a second horizontal position where the pivoting shelf is disposed above and parallel to the rollers and below the dispense outlet, in the second horizontal position, the pivoting shelf is disposed below the dispense outlet a second vertical distance sufficient to permit 1 gallon cylindrical container to be disposed on top of the pivoting shelf and below the dispense outlet.

11. The paint dispenser of claim 10 further comprising a nesting mechanism for a releasably placing the pivoting shelf in the second horizontal position and for releasably placing the pivoting shelf in the first vertical position.

12. The paint dispenser of claim 11 wherein nesting mechanism comprises a stationary frame coupled to the cabinet, an upper arm pivotally connecting the pivoting shelf to the frame, and a lower arm pivotally connecting the pivoting shelf to the frame, the upper arm being pivotally connected to the frame above the lower arm and the upper arm being pivotally connected to the pivoting shelf at a first point along the pivoting shelf disposed above a second point where the lower arm is pivotally connected to the pivoting shelf when the pivoting shelf is in the first vertical position.

13. The paint dispenser of claim 12 wherein the pivoting shelf further comprises a lower foot disposed below the lower arm, the lower foot engaging the lower arm when the pivoting shelf is in the second horizontal position to hold the pivoting shelf in the second horizontal position and prevent further downward pivotal movement of the shelf beyond the second horizontal position.

14. The paint dispenser of claim 13 wherein the lower foot comprises an adjustment mechanism for leveling the pivoting shelf when the pivoting shelf is in the second horizontal position.

15. The paint dispenser of claim 14 wherein the adjustment mechanism comprises a threaded shaft threadably connected to the lower foot.

16. The paint dispenser of claim 12 wherein the lower arm is connected to a spring that, in turn, is connected to the cabinet for biasing the pivoting shelf in the first vertical position.

17. The paint dispenser of claim 10 wherein the pivoting shelf comprises a drip opening in alignment with a drip opening disposed in the horizontal base and in alignment with the dispense outlet.

18. The paint dispenser of claim 17 wherein the horizontal base comprises a drip container disposed below the drip opening of the horizontal base.

19. The paint dispenser of claim 10 wherein the rollers disposed on the base are disposed on either side of the drip opening.

* * * * *